US007021750B2

(12) United States Patent
Shibata et al.

(10) Patent No.: US 7,021,750 B2
(45) Date of Patent: Apr. 4, 2006

(54) IMAGE FORMING DEVICES AND VALVES THAT MAY BE USED IN IMAGE FORMING DEVICES

(75) Inventors: Alan Shibata, Camas, WA (US); David Whalen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 178 days.

(21) Appl. No.: 10/427,586

(22) Filed: Apr. 29, 2003

(65) Prior Publication Data

US 2004/0218020 A1 Nov. 4, 2004

(51) Int. Cl.
*B41J 2/175* (2006.01)

(52) U.S. Cl. ..... 347/85

(58) Field of Classification Search ..... 347/85, 347/86, 87, 65, 94; 138/26, 30
See application file for complete search history.

(56) References Cited

U.S. PATENT DOCUMENTS

| | | | | |
|---|---|---|---|---|
| 3,821,967 | A | | 7/1974 | Sturman et al. |
| 4,080,608 | A | | 3/1978 | Stoneburner et al. |
| 4,221,361 | A | | 9/1980 | Weingarten |
| 4,520,369 | A | | 5/1985 | Shackleton |
| 5,628,490 | A | | 5/1997 | Roberts |
| 5,969,736 | A | * | 10/1999 | Field et al. ..... 347/85 |
| 6,062,681 | A | * | 5/2000 | Field et al. ..... 347/65 |
| 6,095,123 | A | | 8/2000 | Kotwicki et al. |
| 6,095,490 | A | | 8/2000 | Nakano et al. |
| 6,321,776 | B1 | | 11/2001 | Pratt et al. |
| 6,485,137 | B1 | | 11/2002 | Karlinski et al. |
| 2003/0025099 | A1 | | 2/2003 | Nakata et al. |

* cited by examiner

*Primary Examiner*—K. Feggins

(57) ABSTRACT

Image forming devices and valves that may be used in image forming devices.

18 Claims, 9 Drawing Sheets

IMAGE FORMING DEVICES AND VALVES THAT MAY BE USED IN IMAGE FORMING DEVICES

BACKGROUND OF THE INVENTIONS

1. Field of the Inventions

The present inventions are related to image forming devices and valves that may, for example, be used in image forming devices.

2. Description of the Related Art

A wide variety of image forming devices are currently available. Such devices include, but are not limited to, printers, plotters, facsimile machines, copiers, and "all-in-one" devices that are capable of printing, copying, scanning and facsimile transmission. Ink-jet pens ("or print cartridges") are provided in many image forming devices. Such pens typically include a printhead with an orifice plate that has a plurality of small nozzles. Ink is ejected through the nozzles to form images by, for example, heating the ink with heating elements that are associated with respective nozzles. The nozzles are connected to a passive regulator, which maintains the internal pen pressure, by an internal valve and capillary tubes. Ink reservoirs, which may be positioned at remote locations within or near the image forming devices, are used to supply ink to the ink-jet pens by way of a supply line. Many ink reservoirs are pressurized so that they will be able to deliver ink to the pens regardless of the position of the reservoirs relative to the pens.

In order to prevent leakage, the pressure at the printhead in some image forming devices will be slightly lower than the ambient atmospheric pressure (referred to herein as "back-pressure") when the pen is powered off and the ink pressure source is removed. The back-pressure must be large enough to prevent leakage when the pens are not in use, and small enough to allow the printhead, when activated, to overcome the back-pressure and eject ink droplets in a consistent and predictable manner. Too much back-pressure can cause ink back flow which may, in turn, siphon enough ink out of the pen nozzles and capillary tubes to dry out the nozzles and capillary tubes, thereby "de-priming" the pen. De-priming the capillary tubes reduces the nozzle suction to a level that is insufficient to pull ink into the nozzle. This can cause the printheads to overheat and fail, and most pens are incapable of self-priming to restart the ink flow after being de-primed. Additionally, as a pen is de-primed, excess air will be drawn into the regulator and cause the regulator to malfunction.

The present inventors have determined that the back-pressure within ink supply lines can occasionally be too high for the pressure regulators which, in turn, will result in de-priming and damage to the printheads. The present inventors have also determined that the passive pressure regulators associated with the pens are not designed to maintain a seal for long periods of time and, accordingly, can leak. If the pressure regulators leak, de-priming may occur even in those instances where the back-pressure is not too high for the pressure regulators.

BRIEF DESCRIPTION OF THE DRAWINGS

Detailed description of embodiments of the inventions will be made with reference to the accompanying drawings.

DETAILED DESCRIPTION

The following is a detailed description of the best presently known modes of carrying out the inventions. This description is not to be taken in a limiting sense, but is made merely for the purpose of illustrating the general principles of the inventions. It is noted that detailed discussions of certain aspects of image forming devices that are not pertinent to the present inventions, such as media trays and feed rollers, have been omitted for the sake of simplicity. The present inventions are also applicable to a wide range of printers, including those presently being developed or yet to be developed. For example, although exemplary valves are described below in the context an ink jet printer, other types of printers, such as piezo printers, are equally applicable to the present inventions. Additionally, the valves described below may have application in a wide variety of other non-image forming devices including, for example, low pressure systems such as chemical mixing systems, hydroponics systems and drip irrigation systems. Other exemplary non-image forming applications includes pressurized fluid systems where electrical valve controls are either unavailable or undesirable because electricity is unavailable, electromagnetic interference is an issue, or the valve is located in an explosive environment.

Figure 1:
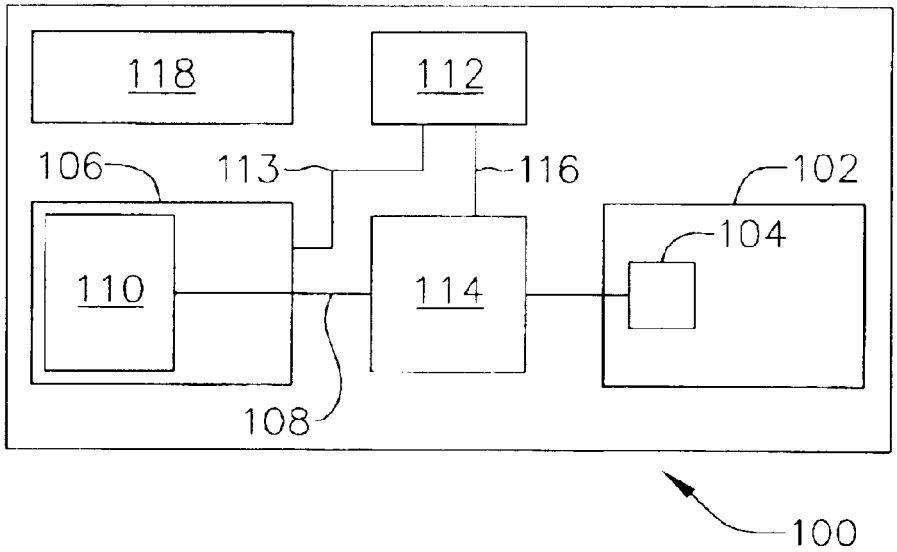
FIG. 1 is a diagrammatic view of an ink-jet printer in accordance with an embodiment of a present invention.

As illustrated for example in FIG. 1, an image forming device 100 in accordance with an embodiment of a present invention includes at least one ink-jet pen 102 with a pressure regulator 104. The exemplary pressure regulator 104 is a "passive" device, i.e. a device that is configured to operate without an external control, such as a "flapper" valve or ball check valve. A pressurized ink supply 106 supplies ink to the pen 102 by way of an ink supply line 108. The exemplary ink supply 106 includes a bladder 110 or other variable volume device. The ink supply 106 is selectively pressurized by supplying pressurized fluid from a fluid source 112 by way of a supply line 113. A suitable pressurized fluid is pressurized air and a suitable source of pressurized air is an air pump. In those instances where multiple ink supplies 106 are present, the fluid source 112 may be connected to each ink supply or, alternatively, multiple fluid sources may be provided.

A valve 114 is positioned along the ink supply line 108 between the pen 102 and the ink supply 106. The valve 114 is preferably an "active" device, i.e. a valve that can be selectively opened and/or closed in response to external control. When closed, the valve 114 will prevent fluid flow from the ink supply 106 to the pen 102, and will prevent back-flow from the pen to the ink supply. Although image forming devices in accordance with the present inventions are not limited to any particular active valve configuration, the exemplary valve 114, which is described in greater detail below with reference to FIGS. 3–6, is configured such that it is biased to the closed position and can be opened by selectively supplying pressurized fluid to a portion of the valve. A suitable pressurized fluid is pressurized air and a suitable source is the fluid source 112, which also supplies pressurized fluid to the ink supply 106. The pressurized fluid is supplied to the valve 114 by way of an inlet line 116 and is vented when the valve is to be closed. In those instances where multiple ink supplies 106 are present, multiple valves 114 may be provided and the fluid source 112 may be connected to each valve or, alternatively, multiple fluid sources may be provided.

Figure 2:
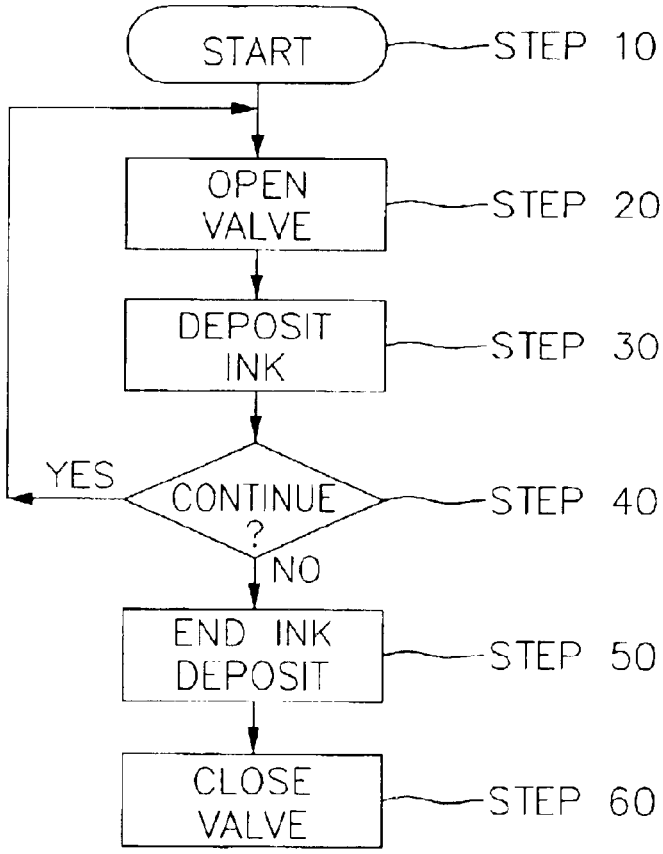
FIG. 2 is a flow chart showing an image formation process in accordance with an embodiment of a present invention.
Figure 3:
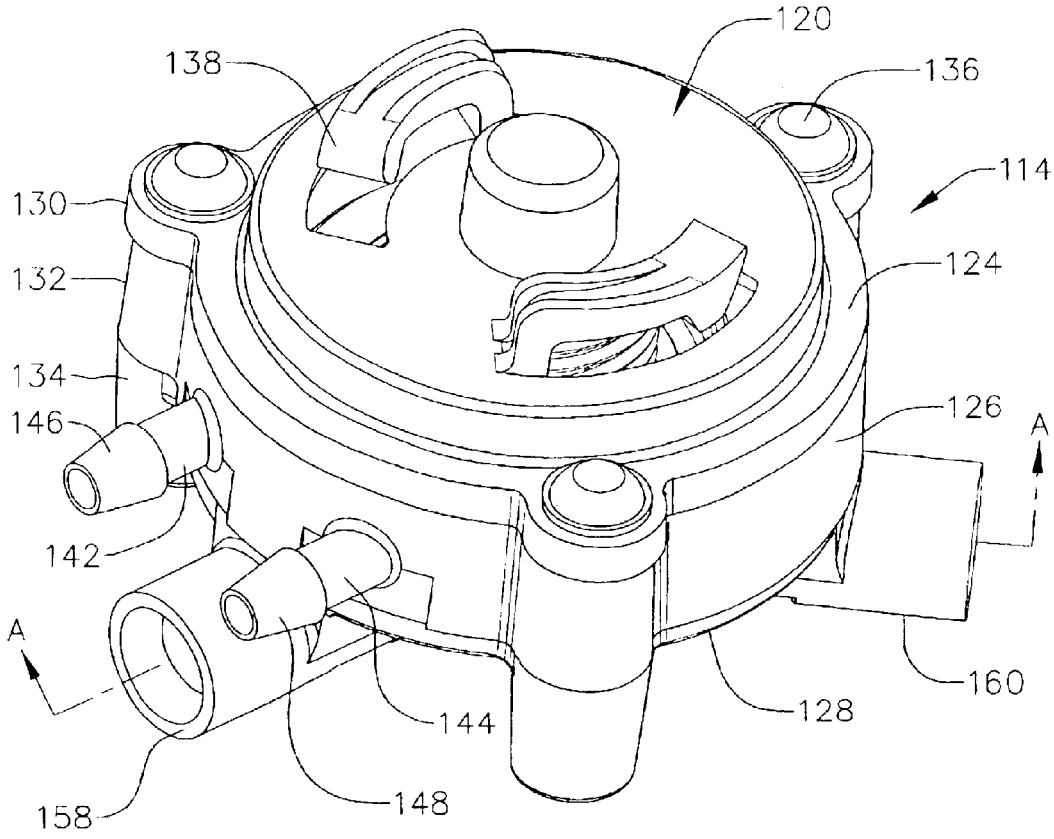
FIG. 3 is a top perspective view of a valve in accordance with an embodiment of a present invention.
Figure 4:
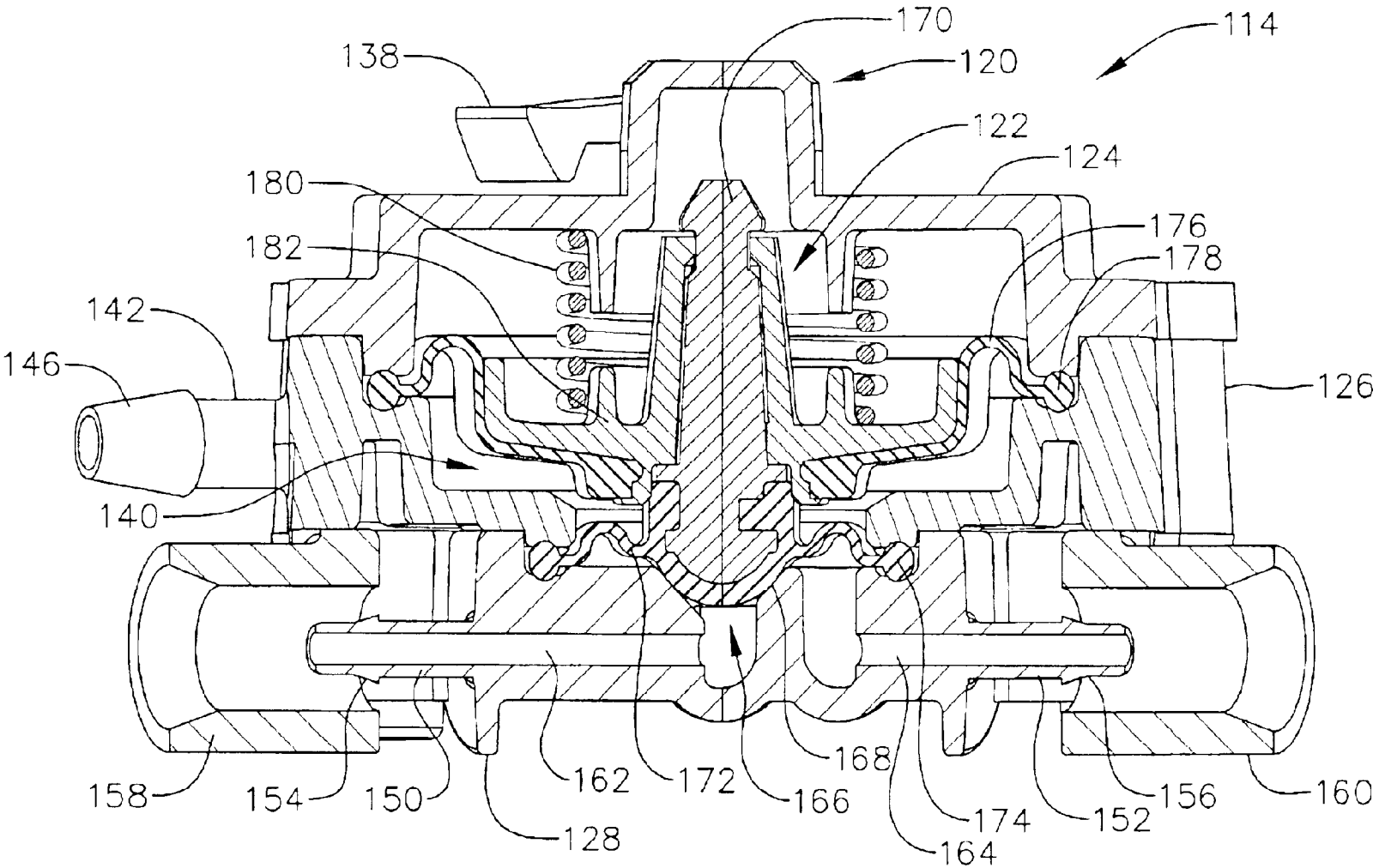
FIG. 4 is a section view taken along line A—A in FIG. 3 with the valve in a closed orientation.

A system controller 118 controls the operation of the image forming device 100, including the operation of the pen 102 and valve 114, in the exemplary implementation. The system controller 118 causes the valve 114 to be open during the printing process. More specifically, and referring to FIG. 2, when the printing process is initiated (step 10), the controller 118 will instruct the fluid source 112 to supply pressurized fluid to the ink supply 106. The controller 118 will also cause the valve 114 to open by instructing the fluid source 112 to supply pressurized fluid to the valve (step 20). Typically, the valve 114 will be open before printing starts, although other configurations are possible. The controller 118 monitors air pressure to determine whether the valve 114 is open and whether there is sufficient pressure within the ink supply 106 for printing. The pen 102 will then deposit ink onto paper or some other print media (step 30). The valve 114 will remain open (step 40) during the printing process. When the printing process is complete, or is stopped by the controller 118 for some other reason such as a paper jam, pen servicing or ink supply replacement, the pen 102 will stop depositing ink (step 50) and the fluid source 112 will stop supplying pressurized fluid to the ink supply 106 and to the valve 114, thereby allowing the valve to close (step 60).

There are a number advantages associated with the exemplary image forming device and method. For example, the valve 114 isolates the pen 102 from the ink supply 106, as well as a portion of the supply line 108, when the image forming device 100 is not in use. Such isolation, coupled with the presence of ink in the supply line between the pen 102 and valve 114, reduces the likelihood that excessive back pressure will damage the pen when it is not being used to deposit ink on a print media. Additionally, because the pressurized fluid source 112 is actuated when printing starts, and deactivated when printing stops, the present valve 114 may be added to conventional image forming devices without substantial modification to the software or firmware that is used to control the device.

As illustrated for example in FIGS. 3–6, the exemplary valve 114 includes a housing 120 and a valve assembly 122 that is located within the housing. The exemplary housing 120 consists of a top portion 124, an intermediate portion 126 and a bottom portion 128. The top, intermediate and bottom portions 124, 126 and 128 of the housing 120 are each provided with respective mounting tabs 130, 132 and 134. The mounting tabs 130 and 132 include clearance holes for the screws 136 that hold the housing portions together, while the mounting tabs 134 include threaded openings the screws or are sized for self-tapping screws. The top portion 124 is also provided with mounting members 138 that allow the valve to be secured to a portion of the image forming device chassis. The intermediate portion 126 defines a fluid cavity 140 which receives pressurized fluid (such as pressurized air) when the valve 114 is being opened. To that end, the intermediate portion 126 is provided with inlet and outlet ports 142 and 144. Barbs 146 and 148, which are located on the ends of inlet and outlet ports 142 and 144, allow fluid tubes (such as a pair of supply lines 116) to be securely connected to the fluid inlet and outlet ports.

The outlet port 144 will be plugged in those instances where there is only one valve 114, as well as in those instances where a plurality of valves are connected to a single fluid source 112 by a respective plurality of supply lines 116, or a plurality of valves are individually connected to a respective plurality of fluid sources. Alternatively, a plurality of valves 114 may be connected in series (or "daisy chained") by connecting the outlet port 144 of all but the last valve to the inlet port 142 of the next valve in the series, and by plugging the outlet port of the last valve. Here, a single fluid source 112 and supply line 116 can be used to supply pressurized fluid to all of the valves.

The ink (or other fluid that is being controlled by the valve 114) passes through the bottom portion 128 of the exemplary housing 120 when the valve is open. To that end, and referring more specifically to FIG. 4, the bottom portion 128 is provided with a fluid inlet port 150 and a fluid outlet port 152. The fluid inlet and outlet ports 150 and 152 are provided with barbs 154 and 156 to facilitate connection to fluid tubes. The bottom portion 128 also includes strain relief devices 158 and 160 to protect the fluid tubes.

After entering the housing 120 by way of the fluid inlet port 150, the ink will pass though an inlet line 162 and an outlet line 164 on its way to the outlet port 152. The inlet line 162 and outlet line 164 are connected to one another by a connector region 166, which may be selectively opened and closed by the valve assembly 122. The ink will not flow in either direction when the valve assembly 122 is in the closed position illustrated in FIG. 4 because a portion of the valve assembly 122 will rest in the valve seat 168 and prevent fluid from crossing the connector region 166. In the context of the exemplary image forming device 100, the valve 114 will prevent ink in the supply line 108 from flowing to or from the pen 102. When the valve assembly 122 is in the open position illustrated in FIG. 5, there will be a gap between the valve assembly 122 and the valve seat 168 that permits fluid flow.

Figure 5:
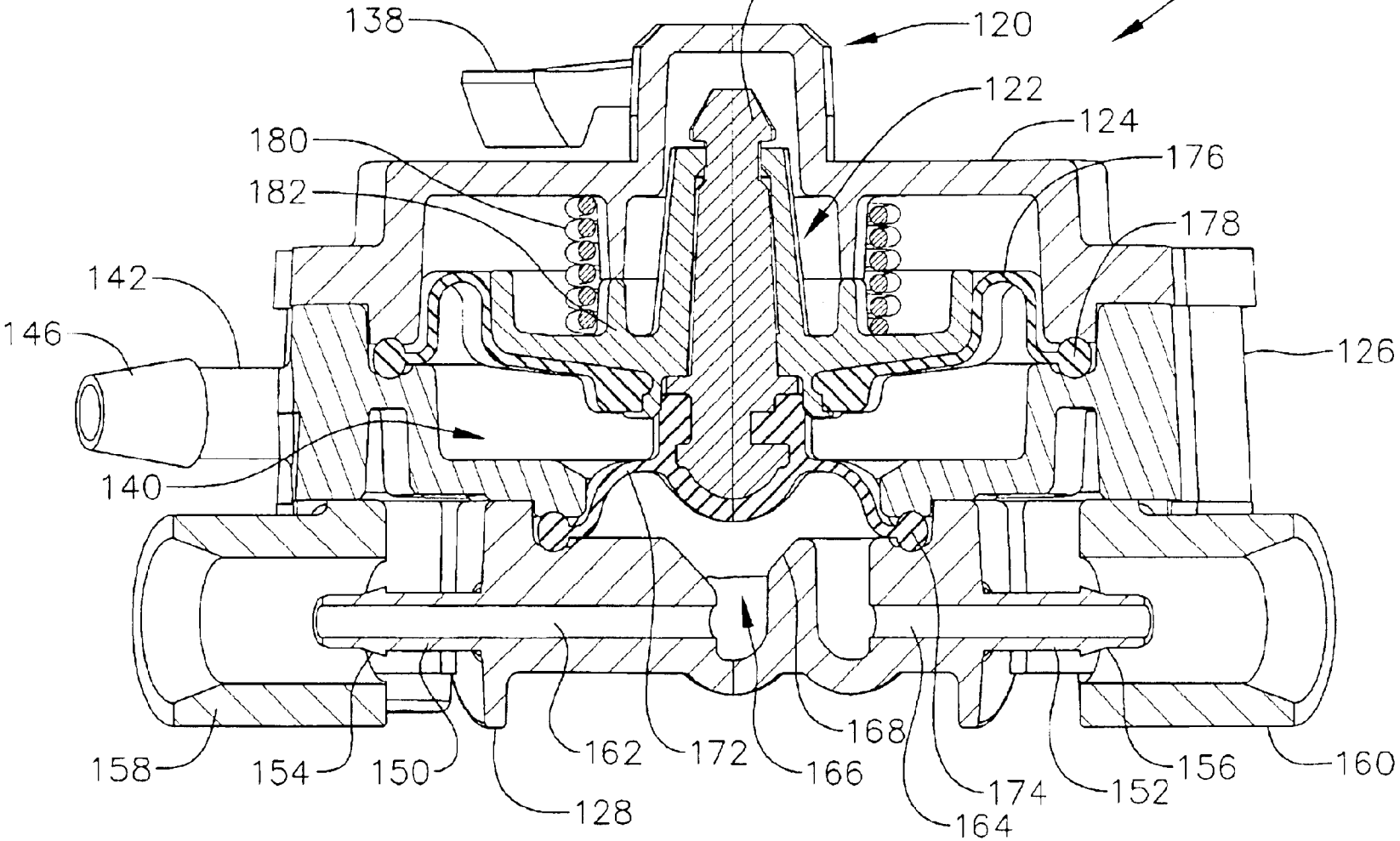
FIG. 5 is a section view taken along line A—A in FIG. 3 with the valve in an open orientation.
Figure 6:
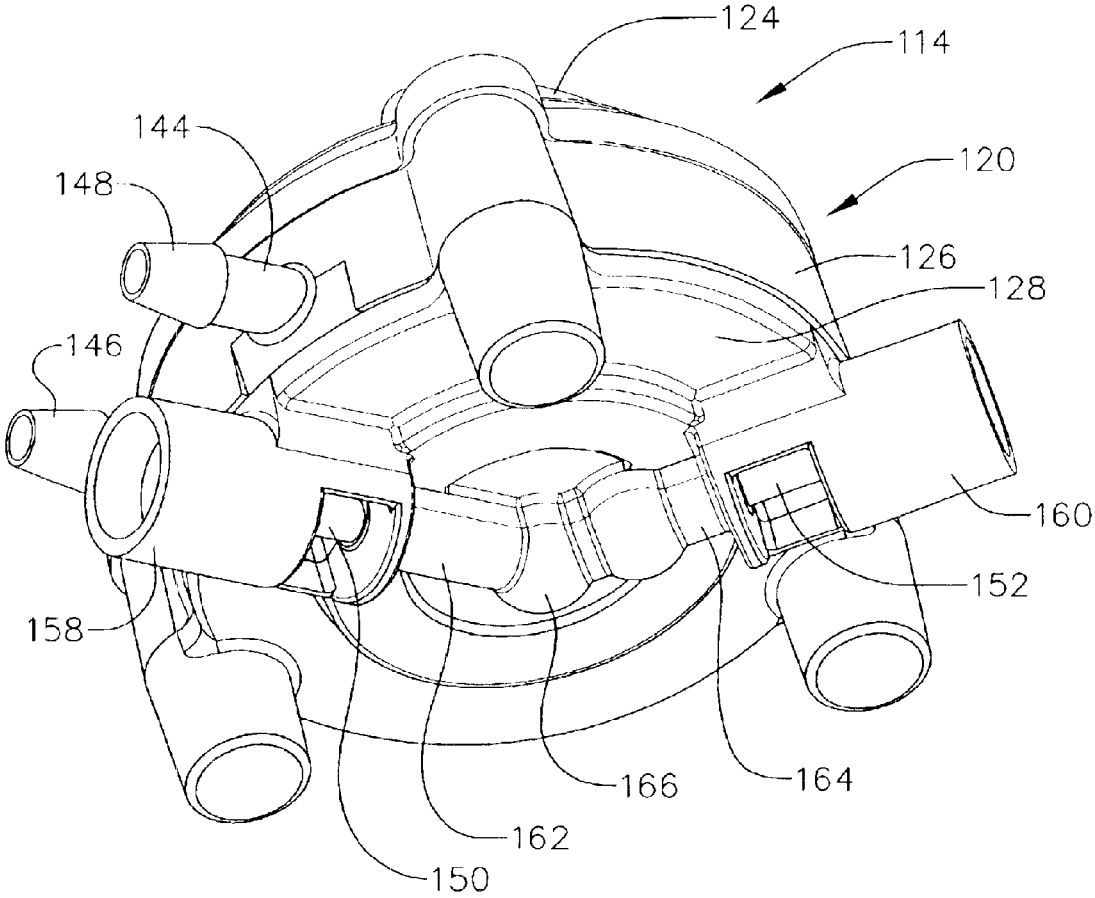
FIG. 6 is a bottom perspective view of the valve illustrated in FIG. 3.
Figure 7:
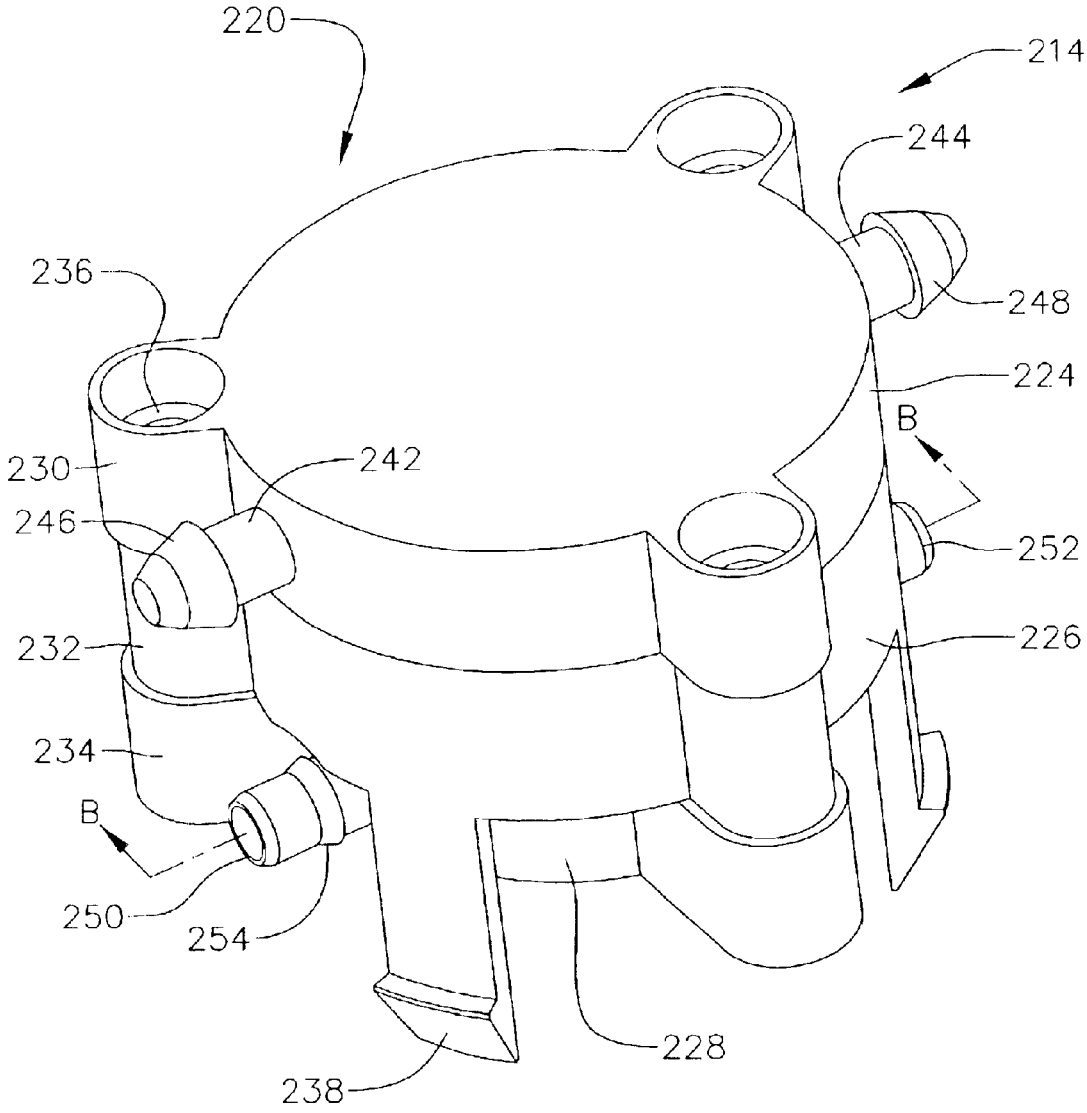
FIG. 7 is a top perspective view of a valve in accordance with an embodiment of a present invention.

The exemplary valve assembly 122 employs a center stem 170 and a relatively small rolling diaphragm 172 to engage the valve seat 168 when the valve is closed (FIG. 4), thereby blocking fluid flow between the inlet line 162 and outlet line 164. The rolling diaphragm 172 also defines the top portion of the connector region 166 when the valve is open (FIG. 5). Although the exemplary valve 114 is not limited to any particular sealing arrangement, the rolling diaphragm 172 includes an integral o-ring 174 that is engaged by the housing intermediate and bottom portions 126 and 128. The o-ring 174 prevents ink (or other fluids) from escaping into the pressurized fluid cavity 140, and also prevents the pressurized fluid within the cavity from entering the inlet and outlet lines 162 and 164. In other words, the rolling diaphragm 172 and o-ring 174 define the bottom portion of the fluid cavity 140. The top portion of the fluid cavity 140 is defined by a relatively large rolling diaphragm 176. The exemplary rolling diaphragm 176 also includes an integral o-ring 178 that is engaged by the housing top and intermediate portions 124 and 126. The sides of the fluid cavity 140 are defined by the housing intermediate portion 126.

The center stem 170 and rolling diaphragm 172 are biased to the closed position (FIG. 4) by a biasing device such as, for example, a compression spring 180. One end of the spring 180 abuts the housing top portion 124, while the other end abuts a shoulder structure 182 that is secured to the center stem 170. The shoulder structure 182 radially centers the spring 180 and also limits the travel of the center stem 170 by engaging the housing top portion 124 after the center stem has traveled a predetermined distance. The surface area of diaphragm 176 is larger than that of diaphragm 172 and, accordingly, the net force on the center stem 170 will be in the upward direction when the fluid cavity receives pressurized fluid. The biasing force of the spring 180 will be overcome, and the valve 114 opened (FIG. 5), when the pressure within the fluid cavity 140 reaches the appropriate level. The spring 180 will return the center stem 170 to the closed position when the fluid cavity 140 is depressurized.

The materials used to form the exemplary valve 114, as well as the overall size and configuration of the valve, will depend on its intended application. In one exemplary implementation that is suitable for use in an ink-jet based image forming device, the top, intermediate and bottom portions of the housing 120 may be formed from plastic such as Noryl® 731, while the center stem 170 and shoulder 182 may be formed from plastic such as Ultem® 1000. Noryl® and Ultem® are manufactured by General Electric. The relatively small rolling diaphragm 172, which will be in contact with ink, may be formed from an elastomeric nitrile polymer, while the relatively large rolling diaphragm 176 may be formed from a thermoplastic elastomer such as Santoprene®, which is manufactured by Advanced Elastomer Systems. The compression spring 180 should generate at least 0.7 lbf., which is sufficient to maintain the integrity of the seal formed by the valve seat 168, center stem 170 and the associated portion of the diaphragm 172 when the valve is closed. With respect to size, the inlet and outlet lines 162 and 164 are about 0.09 inch in diameter, which is suitable for an ink flow rate of 6 $in.^3$/min. The effective surface area of the relatively small rolling diaphragm 172 is about 0.09 $in.^2$, while the effective surface area of the relatively large rolling diaphragm 176 is about 0.8 $in.^2$. So configured, a pressure of about 0.75 PSI within the fluid cavity 140 drives the center stem 170 to the open position.

Another exemplary valve that may be used in conjunction with the image forming device 100, as well as other devices that employ valves, is generally represented by reference numeral 214 in FIGS. 7–10. Valve 214 is similar to valve 114 in many respects and similar elements are represented by similar reference numerals. The exemplary valve 214 includes a housing 220 and a valve assembly 222 that is located within the housing. The exemplary housing 220 consists of a top portion 224, an intermediate portion 226 and a bottom portion 228. The top, intermediate and bottom portions 224, 226 and 228 of the housing 220 are each provided with respective mounting tabs 230, 232 and 234. The mounting tabs 230 and 232 include clearance holes for the screws 236 that hold the housing portions together, while the mounting tabs 234 include threaded openings the screws or are sized for self-tapping screws. The intermediate portion 226 is also provided with mounting members 238 that may be used to secure the valve 214 to a portion of the image forming device chassis. The top portion 224 defines a fluid cavity 240 which receives the pressurized fluid when the valve 214 is being opened. To that end, the top portion 224 is provided with inlet and outlet ports 242 and 244. Barbs 246 and 248, which are located on the ends of fluid inlet and outlet ports 242 and 244, allow fluid tubes to be securely connected to the fluid inlet and outlet ports.

The outlet port 244 will be plugged in those instances where there is only one valve 214, as well as in those instances where a plurality of valves are connected to a single fluid source 112 by a respective plurality of supply lines 113, or a plurality of valves are individually connected to a respective plurality of fluid sources. Alternatively, a plurality of valves 214 may be connected in series (or "daisy chained") by connecting the outlet port 244 of all but the last valve to the inlet port 242 of the next valve in the series, and by plugging the outlet port of the last valve. Here, a single fluid source 112 and supply line 113 can be used to supply pressurized fluid to all of the valves.

The ink (or other fluid that is being controlled by the valve 214) passes through the bottom portion 228 of the exemplary housing 220, which is provided with a fluid inlet port 250 and a fluid outlet port 252. Here too, the fluid inlet and outlet ports 250 and 252 are provided with barbs 254 and 256 to facilitate connection to fluid tubes. Strain relief devices, such as those illustrated in FIGS. 3–6, may also be provided to protect the fluid tubes.

Figure 8:
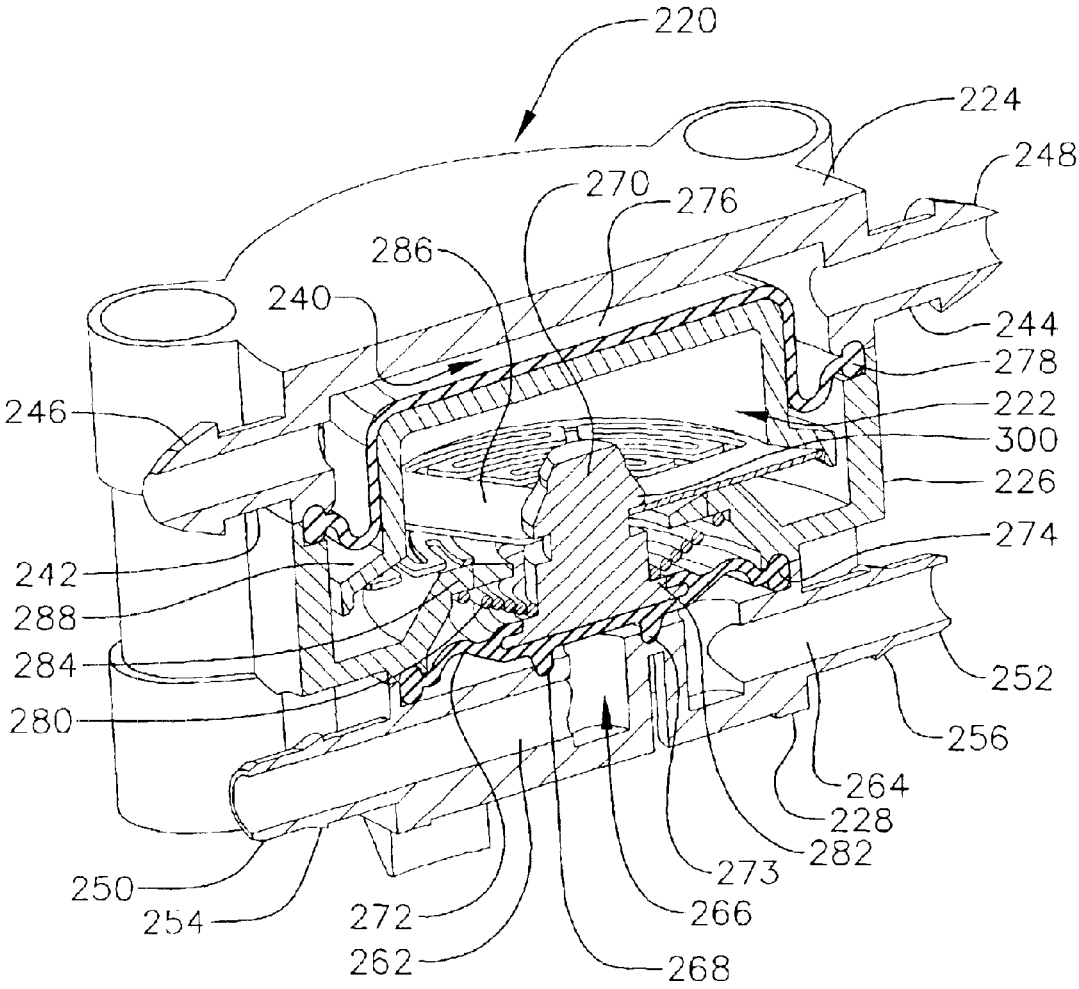
FIG. 8 is a section view taken along line B—B in FIG. 7 with the valve in a closed orientation.
Figure 9:
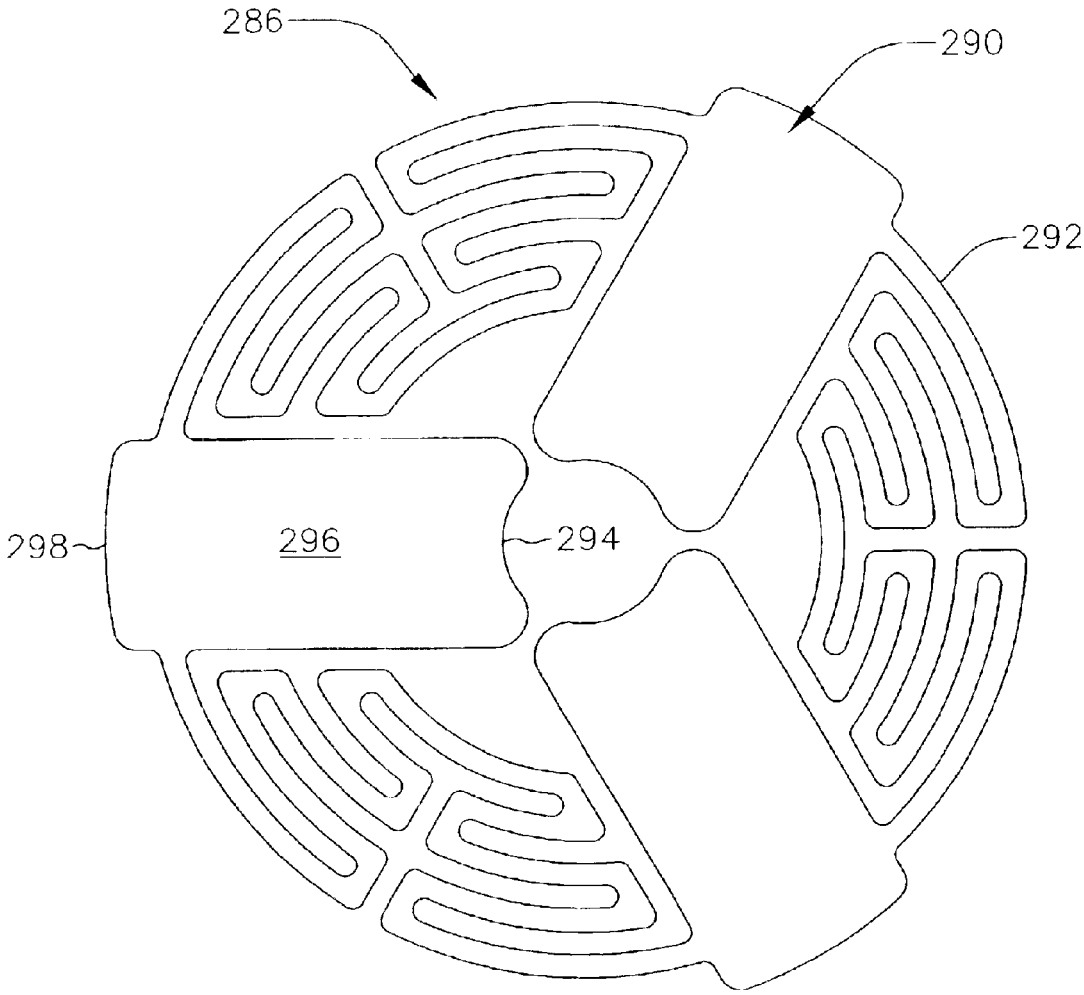
FIG. 9 is a plan view of a lever plate in accordance with an embodiment of a present invention.

Referring to FIGS. 8 and 9, after entering the fluid inlet port 250, the ink will pass though an inlet line 262 and an outlet line 264 on its way to the outlet port 252. The inlet and outlet lines 262 and 264 are connected to one another by a connector region 266. A valve seat 268 is associated with the connector region 266. The exemplary valve assembly 222 employs a center stem 270 and a rolling diaphragm 272 to engage the valve seat 268 and block fluid flow between the inlet line 262 and outlet line 264 when the valve is closed (FIG. 8). The rolling diaphragm 272, which also defines the top portion of the connector region 266 when the valve 214 is open (FIG. 10), includes a generally circular cup 273 which engages the generally circular valve seat 268. The rolling diaphragm 272 also includes an integral o-ring 274 that is engaged by the housing intermediate and bottom portions 226 and 228 to prevent ink (or other fluids) from escaping from the connector region 266. Other types of seals may be used in place of the o-ring if desired.

Turning to the pressurized fluid cavity 240, the top and sides of the fluid cavity are defined by the housing top portion 224, while the bottom of the fluid cavity is defined by a rolling diaphragm 276. The exemplary rolling diaphragm 276 includes an integral o-ring 278, which is engaged by the housing top and intermediate portions 224 and 226, for preventing leakage from the fluid cavity 240. Here too, other types of seals may be used in place of the o-ring if desired.

The center stem 270 and rolling diaphragm 272 are biased to the closed position by a biasing device such as, for example, a compression spring 280. One end of the spring 280 abuts a shoulder 282 on the center stem 270, while the other end abuts a support arm 284. The support arm 284 in the illustrated embodiment is associated with, and is preferably integral with, the housing intermediate member 226. In addition to providing an abutment for the spring 280, the support arm 284 also supports a lever plate 286 and a cap 288. The lever plate and cap arrangement, which acts a linkage between the center stem 270 and rolling diaphragm 276, drives the center stem and diaphragm 272 from the closed position (FIG. 8) to the open position (FIG. 10) when the fluid cavity 240 receives pressurized fluid. The exemplary lever plate 286, which is best seen in FIG. 9, includes a plurality of lever arms 290. Adjacent lever arms 290 are connected to one another by a flexible web 292 and each lever arm includes an inner portion 294, an intermediate portion 296 and an outer portion 298. The inner portions 294 engage a shoulder 300 on the center stem 270, the intermediate portions 296 are supported on the support arm 284, and the outer portions 298 are engaged by the cap 288. The positioning of the lever plate 286 on the support arm 284, as well as the flexibility of the web 292, enables the lever arms 290 to pivot about the support arm 284.

The lever plate and cap arrangement operates as follows. As pressurized fluid fills the cavity 240 of a closed valve 214

Figure 10:
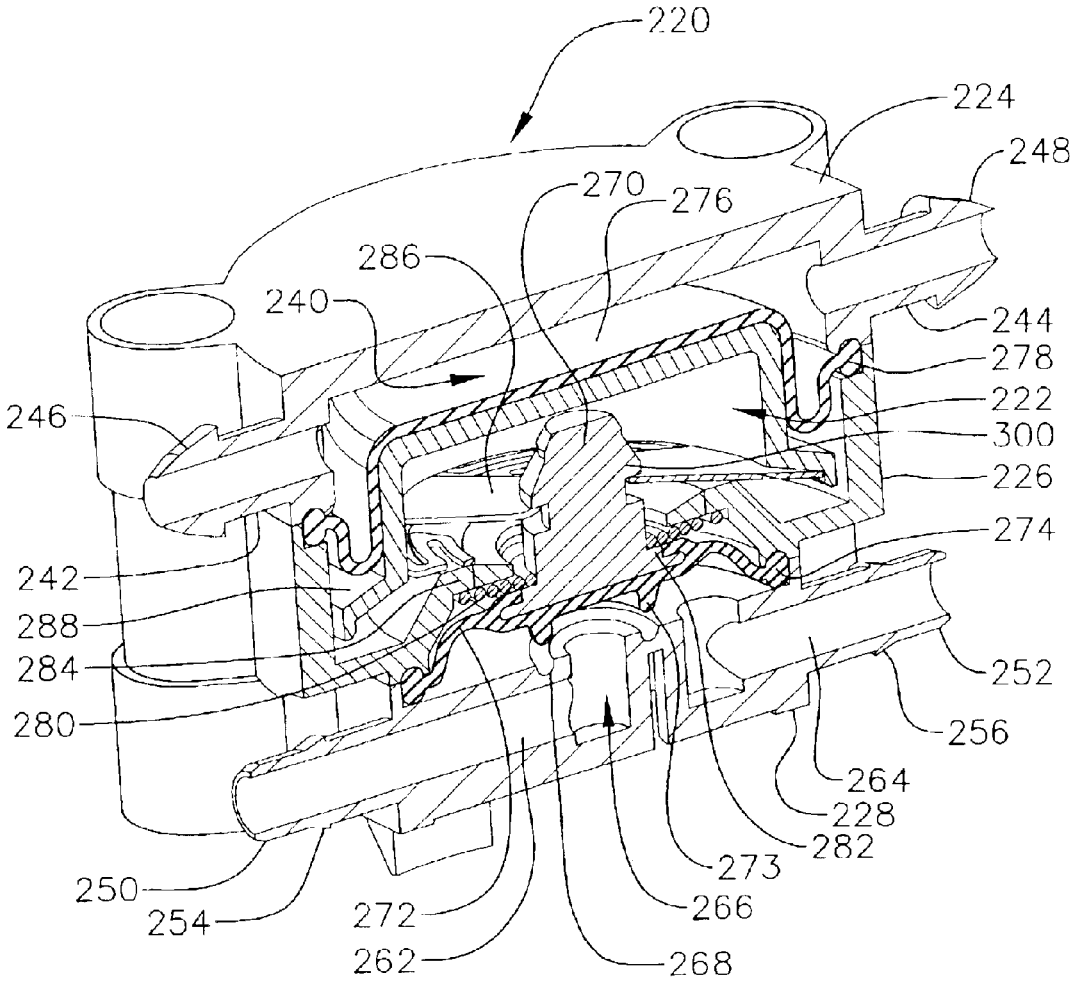
FIG. 10 is a section view taken along line B—B in FIG. 7 with the valve in an open orientation.

(FIG. 8), the diaphragm 276 will apply a downward force on the cap 288. The downward force on the cap 288 will, in turn, apply a downward force on the lever arm outer portions 298. The lever arms 290, which pivot about the support arm 284, will apply an upward force on the center stem 270 with the inner portions 294. When the pressure within the cavity 240 reaches the appropriate level, there will be enough upward force on the center stem 270 to overcome the downward biasing force of the spring 280 and open the valve 214 (FIG. 10).

The materials, size and configuration of the exemplary valve 214 will depend on its intended application. In one exemplary implementation that is suitable for use in an ink-jet based image forming device, the top, intermediate and bottom portions of the housing 220 may be formed from plastic such as Noryl® 731, while the center stem 270 and cap 288 may be formed from plastic such as Ultem® 1000. The rolling diaphragm 272, which will be in contact with ink, may be formed from an elastomeric nitrile polymer, while the rolling diaphragm 276 may be formed from a thermoplastic elastomer such as Santoprene®. The compression spring 280 should generate at least 0.75 lbf., which is sufficient to maintain the integrity of the seal formed by the valve seat 268, center stem 270 and circular cup 273 when the valve is closed. With respect to size, the inlet and outlet lines 262 and 264 are about 0.09 inch in diameter, which is suitable for an ink flow rate of 6 in.$^3$/min. The effective surface area of the diaphragm 276 is about 0.8 in.$^2$. So configured, a pressure of about 1 PSI within the fluid cavity 240 drive the center stem 270 to the open position.

Although the present inventions have been described in terms of the embodiments above, numerous modifications and/or additions to the above-described embodiments would be readily apparent to one skilled in the art. It is intended that the scope of the present inventions extend to all such modifications and/or additions. Additionally, the scope of the inventions includes any combination of the elements from the various species and embodiments disclosed in the specification that are not already described.

We claim:

1. An image forming device, comprising:

an ink supply line;

an ink deposition device including a pressure regulator; and an active valve including a housing having an inlet operably connected to the ink supply line and an outlet operably connected to the ink deposition devices, a valve member movable between a closed position that prevents flow between the inlet and the outlet and an open position that allows flow between the inlet and the outlet, and first and second diaphragms defining a fluid cavity therebetween that extends from the first diaphragm to the second diaphragm, at least the first diaphragm being operably connected to the valve member such that movement of the first diaphragm results in movement of the valve member.

2. An image forming device as claimed in claim 1, further comprising:

an ink supply operably connected to the ink supply line.

3. An image forming device as claimed in claim 2, wherein the ink supply comprises a pressurized ink supply.

4. An image forming device as claimed in claim 1, wherein the ink deposition device comprises at least one ink-jet pen.

5. An image forming device as claimed in claim 1, wherein the pressure regulator comprises a passive valve.

6. An image forming device as claimed in claim 1, wherein the valve member is biased to the closed position.

7. An image forming device as claimed in claim 6, further comprising:

a device controller that causes the valve member to be in the open position when the ink deposition device is depositing ink and allows the valve member to be in the closed position when the ink deposition device is not depositing ink.

8. An image forming device as claimed in claim 6, further comprising:

a source of pressurized fluid operably connected to the fluid cavity;

wherein the valve member is configured to move to the open position in response to the receipt of pressurized fluid.

9. An image forming device as claimed in claim 8, wherein the ink supply is operably connected to the source of pressurized fluid.

10. An image forming device as claimed in claim 1, wherein the ink supply line includes a first portion connected to the housing inlet and a second portion extending from the housing outlet to the ink deposition device.

11. An image forming device as claimed in claim 1, wherein the housing includes a connector region that connects the inlet to the outlet and the second diaphragm separates the connector region from the fluid cavity.

12. An image forming device as claimed in claim 11, wherein the connector region includes a valve seat and the second diaphragm engages the valve seat when the valve member is in the closed position.

13. An image forming device as claimed in claim 1, further comprising:

a biasing member that biases the valve member to the closed position.

14. An image forming device as claimed in claim 1, wherein the first and second diaphragms define respective surface areas within the fluid cavity and the surface area of the first diaphragm is greater than the surface area of the second diaphragm.

15. A method of operating an image forming device, comprising the steps of:

supplying ink from an ink supply to an ink deposition device;

regulating pressure within the ink deposition device with a pressure regulator associated with the ink deposition device;

opening a valve, located between the ink supply and the ink deposition device, by supplying pressurized fluid to a fluid cavity that extends from a first diaphragm to a second diaphragm when the ink deposition device is depositing ink; and closing the valve when the ink deposition device in not depositing ink.

16. A method as claimed in claim 15, wherein the step of supplying ink from an ink supply comprises supplying ink from a pressurized ink supply to an ink deposition device.

17. A method as claimed in claim 15, wherein the step of regulating pressure within the ink deposition device comprises regulating pressure within the ink deposition device with a passive valve associated with the ink deposition device.

18. A method as claimed in claim 15, wherein the step of closing the valve comprises not supplying pressurized fluid to the the fluid cavity that extends from a first diaphragm to a second diaphragm when the ink deposition device is not depositing ink.

* * * * *

UNITED STATES PATENT AND TRADEMARK OFFICE

CERTIFICATE OF CORRECTION

PATENT NO. : 7,021,750 B2
APPLICATION NO. : 10/427586
DATED : April 4, 2006
INVENTOR(S) : Alan Shibata et al.

It is certified that error appears in the above-identified patent and that said Letters Patent is hereby corrected as shown below:

In column 7, line 45, in Claim 1, delete "devices," and insert -- device, --, therefor.

In column 8, line 63, in Claim 18, after "to the" delete "the".

Signed and Sealed this

Sixth Day of October, 2009

David J. Kappos

David J. Kappos
*Director of the United States Patent and Trademark Office*